US007682008B2

(12) United States Patent
Platt et al.

(10) Patent No.: US 7,682,008 B2
(45) Date of Patent: Mar. 23, 2010

(54) PRINTHEAD RESERVOIR WITH SIPHON VENTS

(75) Inventors: David P. Platt, Newberg, OR (US); Sharon S. Berger, Canby, OR (US); Jonathan R. Brick, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 641 days.

(21) Appl. No.: 11/567,161

(22) Filed: Dec. 5, 2006

(65) Prior Publication Data

US 2008/0129808 A1 Jun. 5, 2008

(51) Int. Cl.
*B41J 2/19* (2006.01)
*B41J 2/05* (2006.01)

(52) U.S. Cl. ..... 347/92; 347/65

(58) Field of Classification Search ..... 347/92, 347/65, 50, 68–72, 84–88, 71, 49
See application file for complete search history.

(56) References Cited

U.S. PATENT DOCUMENTS 7,198,360 B2 * 4/2007 Watanabe et al. ..... 347/71
7,241,000 B2 * 7/2007 Hirota et al. ..... 347/85
7,252,369 B2 * 8/2007 Nakamura et al. ..... 347/65
7,252,370 B2 * 8/2007 Hirota ..... 347/68
7,578,569 B2 * 8/2009 Silverbrook ..... 347/13
2009/0213198 A1 * 8/2009 Sassano et al. ..... 347/92

* cited by examiner

*Primary Examiner*—Stephen D Meier
*Assistant Examiner*—Rene Garcia, Jr.
(74) *Attorney, Agent, or Firm*—Marger Johnson & McCollom P.C.

(57) ABSTRACT

A printhead reservoir assembly has at least one reservoir to hold ink. The assembly includes an outlet plate having siphon vents to allow air to exit an ink path, a manifold plate having at least one manifold to channel ink and manifold outlets to corresponding to the siphon vents, a jet stack having an array of jets to transfer ink out of the printhead reservoir assembly to a printing substrate and jet stack outlets corresponding to the siphon vents, and a circuit board between the jet stack and the manifold plate to operate the jet stack, the circuit board having outlets corresponding to the siphon vents.

10 Claims, 5 Drawing Sheets

PRINTHEAD RESERVOIR WITH SIPHON VENTS

BACKGROUND

Solid ink printers use ink in solid form, melt it and then transfer it in liquid form to a printhead. During power cycles, the ink will change phases from solid to liquid to solid, etc., and this generally occurs multiple times during its residence in the printer. This freeze/thaw cycle leaves air bubbles in the system that the system needs to purge, as air bubbles can cause the jets to fail.

Purging generally involves using air pressure to 'clear' the ink lines and conduits and results in both air and waste ink leaving the system. The volume of air leaving the system corresponds to the volume of ink leaving the system. In current applications, the systems generally purge the air through the jets or nozzles used to transfer the ink from the reservoirs to the printing substrate at the 'downstream' end of the ink path. The largest air bubbles that lie the farthest upstream typically require the largest volumes of ink to purge the bubbles since all of the ink in front of the air bubbles must be purged to clear the air bubble even with perfect efficiency. This results in a large volume of waste ink.

As printers move towards a more compact architecture, the removal of bubbles becomes even more inefficient.

SUMMARY

An embodiment includes a printhead reservoir assembly. The printhead reservoir assembly has at least one reservoir to hold ink. The assembly includes an outlet plate having siphon vents to allow air to exit an ink path, a manifold plate having at least one manifold to channel ink and manifold outlets to corresponding to the siphon vents, a jet stack having an array of jets to transfer ink out of the printhead reservoir assembly to a printing substrate and jet stack outlets corresponding to the siphon vents, and a circuit board between the jet stack and the manifold plate to operate the jet stack, the circuit board having outlets corresponding to the siphon vents.

Another embodiment is a printhead reservoir having an ink input port, an ink reservoir to hold ink received through the ink input port, and an air vent in the ink reservoir to vent air from the ink fluid path to the jets.

Another embodiment is a manifold plate having at least one manifold to direct ink to a jet path. Each manifold plate has a bottom edge and a top edge, the top edge being scalloped to form traps, and manifold plate outlets corresponding siphon vents on a back side of the manifold plate such that air exits to a front side of the manifold plate. In addition, each air trap in the manifold plate may have a corresponding manifold vent outlet.

DETAILED DESCRIPTION

Figure 1:
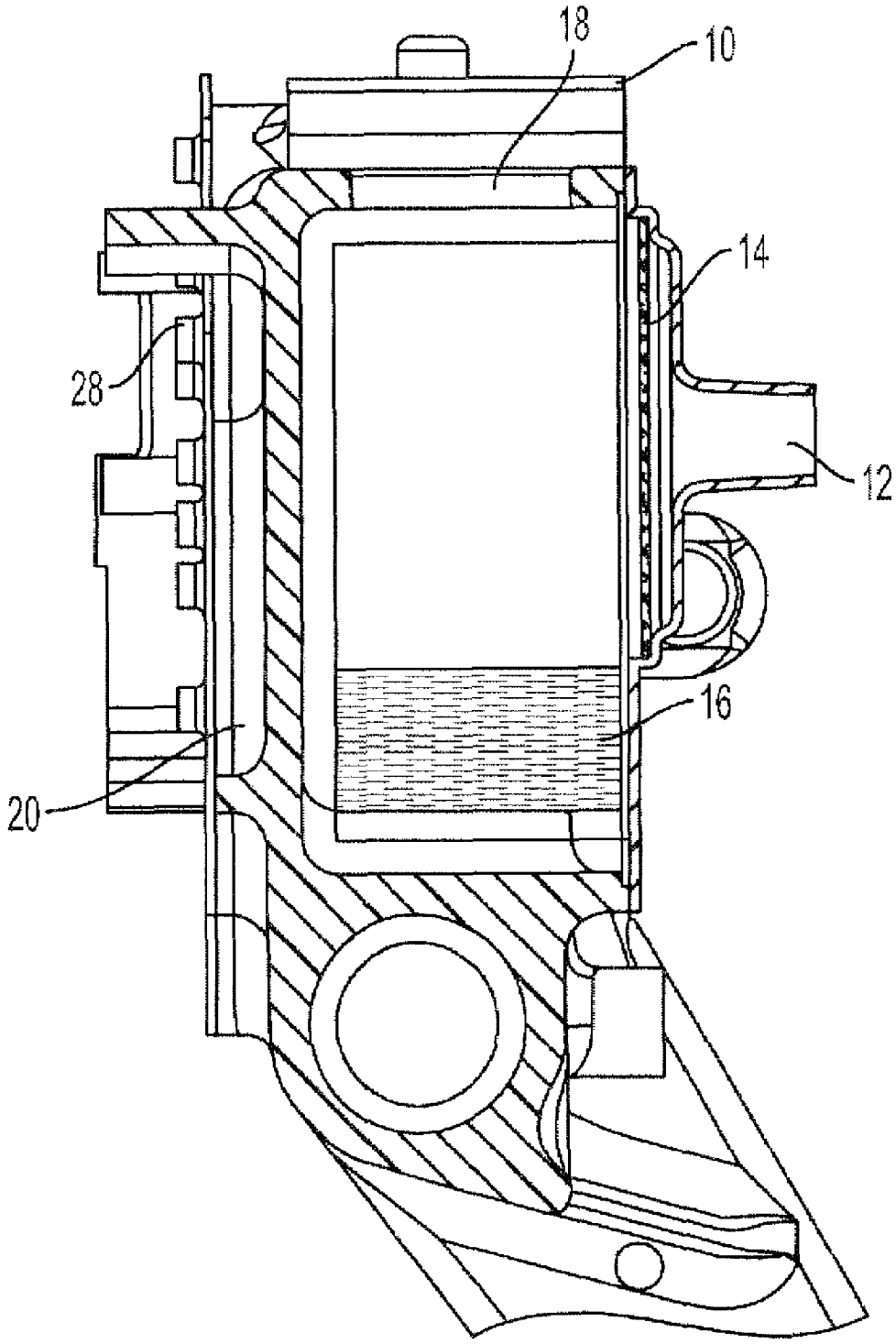
FIG. 1 shows a side view cross-section of an ink reservoir.

FIG. 1 shows an example of a printhead reservoir used in a solid ink print system. 'Print system' as used here means any system that transfers ink to a substrate. Possible substrates include hard copy output substrates, such as papers, transparencies, etc., and intermediate transfer surfaces such as pick up belts and drums. The print system may reside in a printer, a fax machine, a scanner or a copier.

In FIG. 1, the printhead reservoir 10 may include one or more ink reservoirs such as 16. The ink feeds into the ink reservoir through an input ink port 12. The input ink port 12 may connect to an umbilical that delivers ink from an ink source, not shown. The ink reservoir 16 has an air outlet 18 to the surrounding atmosphere. A filter 14 may reside between the ink port 12 and the reservoir 16, and a second filter may reside in the air outlet 18. A pressure source may be attached to the air outlet 18 to provide the purge pressure.

The jet path includes the channel 20 through which the ink travels to the exit ports 28 that lead to the jets. The waste ink generated in the example of FIG. 1 would primarily come from ink downstream of air trapped in the jet path 20 since this is the largest volume of air mixed with ink. The system here has other mechanisms to manage the air trapped in the jet path.

Figure 2:
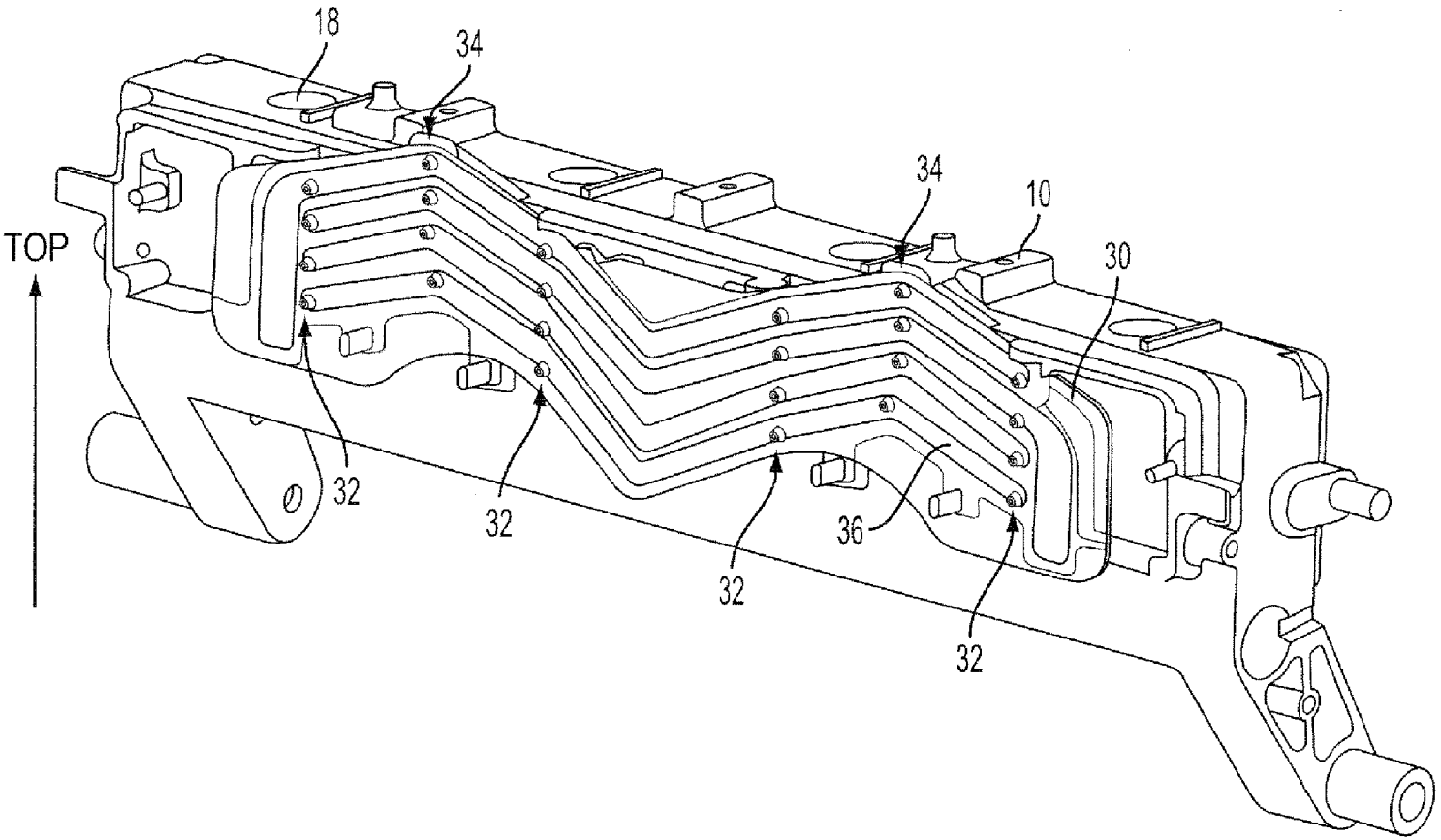
FIG. 2 shows a front view of a printhead reservoir and outlet plate.

FIG. 2 shows an external view of the printhead reservoir 10 with outlet plate 30 to assist in handling air trapped in the jet path. The outlet plate 30 has channels or siphons 36 that pipe ink from the ink reservoir to the jet stack. The particular printhead reservoir shown has four ink reservoirs and four channels. The ink travels through the siphons to the ink outlets 32 for eventual transfer to the jet stack for printing. In current applications, trapped air in the siphons exits these same outlets. In the example in FIG. 2, air travels through the siphons and due to buoyancy will rise to the tops of the channels above the exits to the jet fluid path. The air will then vent through the siphon vents 34, which have corresponding outlets in other plates of the assembly, shown in the successive figures. This vent path is isolated from the jet fluid path, and exits at different locations.

Figure 3:
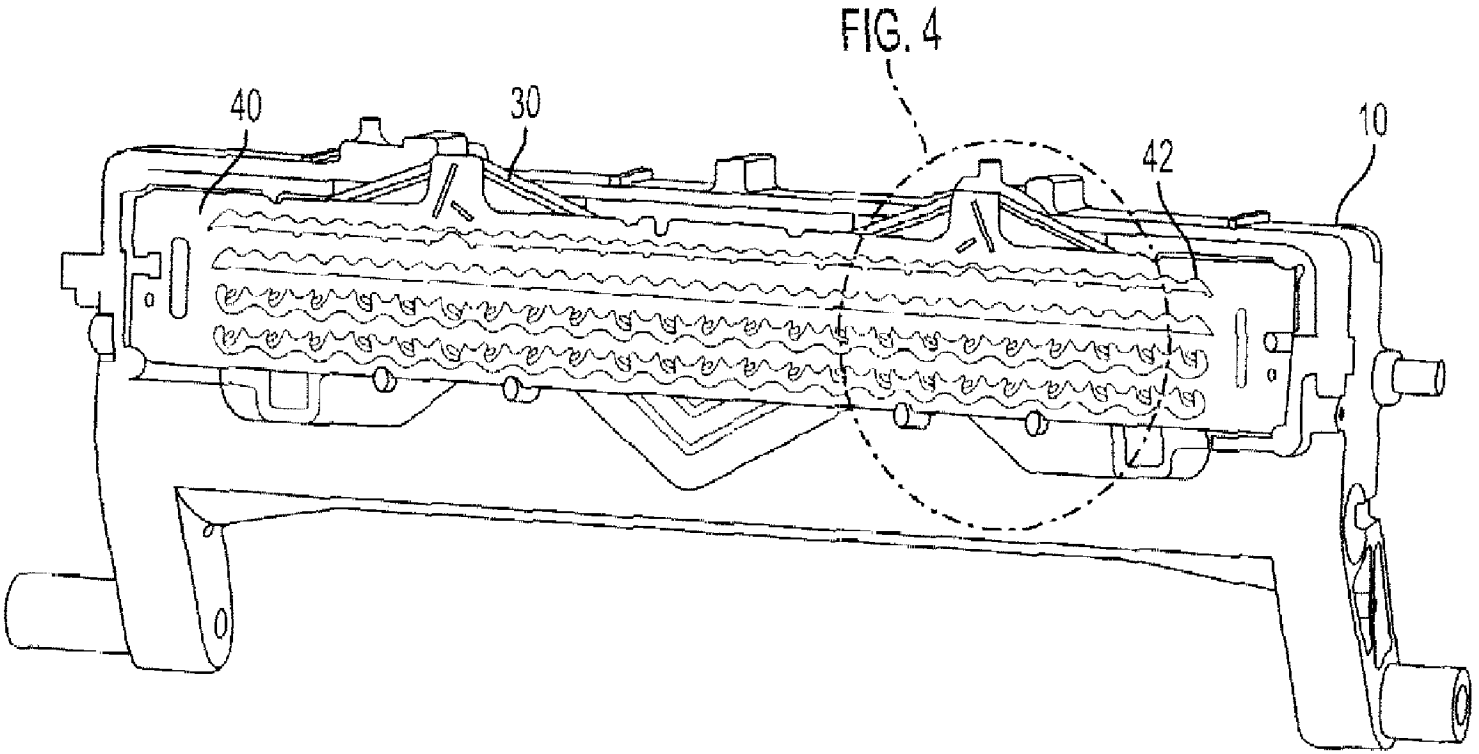
FIG. 3 shows a front view of a printhead reservoir, an outlet plate and a manifold plate.
Figure 4:
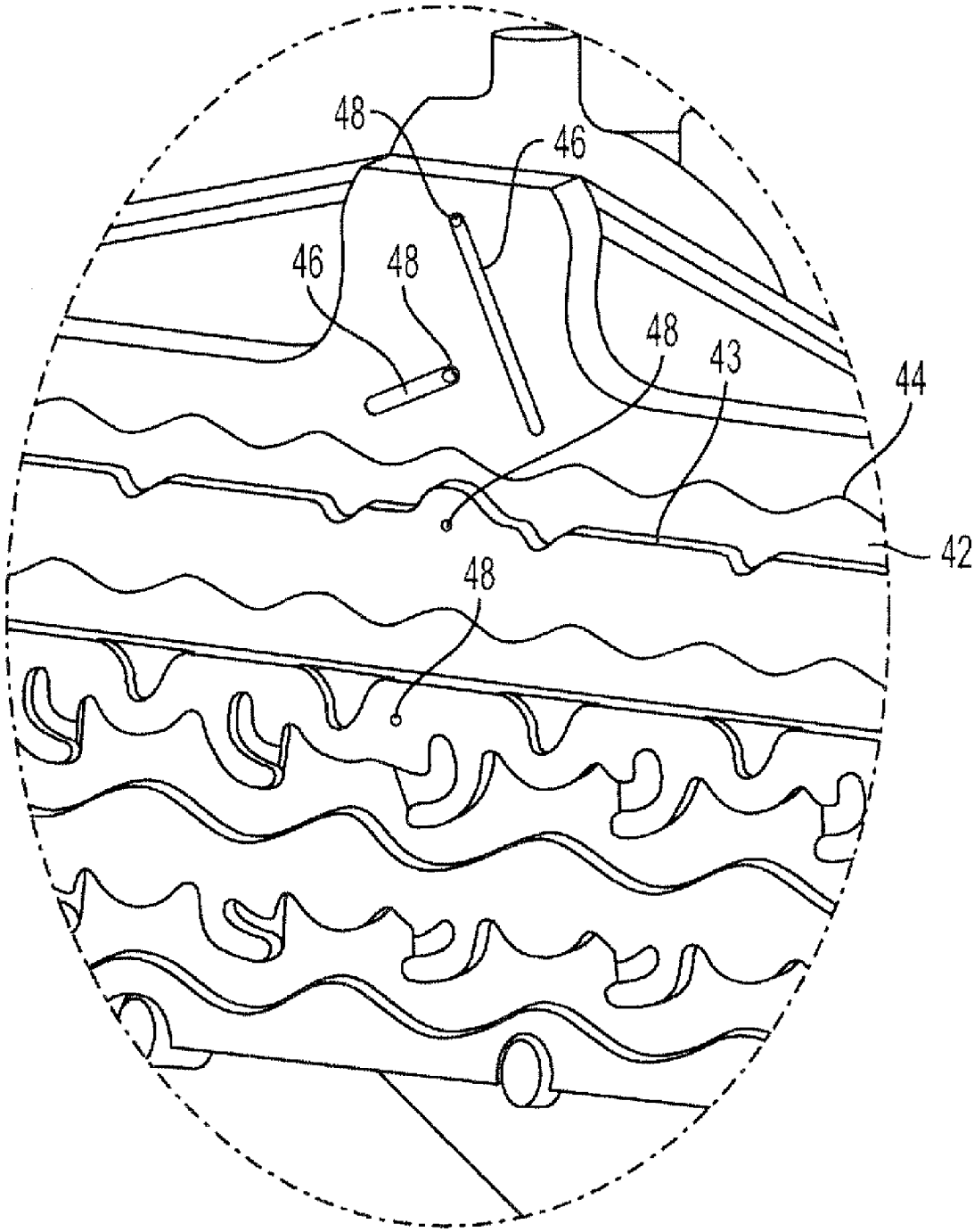
FIG. 4 shows a detailed view of a portion of a manifold plate.

FIG. 3 shows the printhead assembly 10 with the outlet plate 30 and a manifold plate 40. The manifold plate has at least one manifold, such as 42, to distribute the ink in preparation for transfer to the jets. In this instance, four manifolds will transfer four different colors of ink to the jets, cyan, magenta, yellow and black. FIG. 4 shows a detailed view of a portion of the manifolds.

In FIG. 4, the manifolds have two edges, a top edge 44 and a bottom edge 43. The top edges of the manifolds such as 44 have scalloping to form air traps. The air traps take advantage of buoyancy, since air will float to the top of the ink path through the manifolds. The lower manifolds have a higher degree of scalloping to ensure better trapping. In this embodiment, the air trapped in this portion of the ink path forms small enough bubbles that they will dissolve back into the ink and not build up during the cycles of freeze/thaw. The air traps can be any shape that traps the air via buoyancy. In another embodiment, this trapped air may be vented out the jet stack similar to the siphon vents with a vent at the apex of each scallop.

The large volumes of air from the jet path prior to the manifolds will exit the system via the siphon vents on the outlet plate shown in FIG. 2. The manifold plate has manifold plate outlets 48 that correspond to the siphon vents. In addition, the manifold plate has diverter channels such as 46 that divert air into the manifold plate outlets. These outlets will correspond with outlets on successive plates, maintaining an air outlet path through the printhead reservoir assembly, allowing air to vent in a separate path from the jet path.

Figure 5:
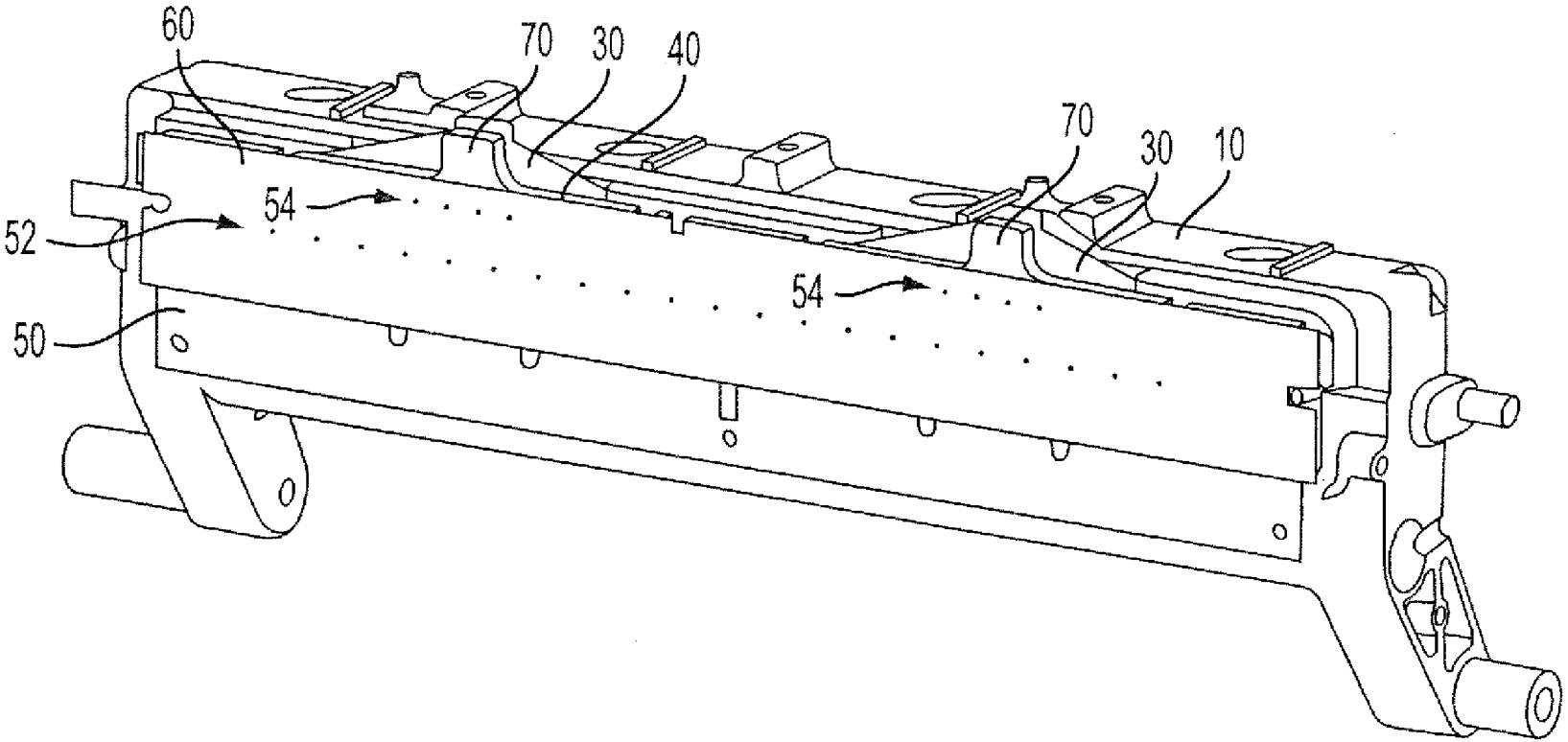
FIG. 5 shows a front view of a printhead reservoir, an outlet plate, a manifold plate, a circuit board, and a jet stack.

FIG. 5 shows an example of a printhead assembly. The assembly includes the printhead reservoir 10, an outlet plate 30, a manifold plate 40, a circuit board 50 and the jet stack 60. The circuit board 50 contains the control circuitry to activate various ones of the jets to form print images. An activated or actuated jet deposits a drop of ink on the printing substrate. The selective dropping or not dropping of the ink dots form the images printed.

The jet stack 60 contains the array of jets, such as those shown in circle 52. The jet stack includes the actuators that actually cause the jets to dispense ink, as well as the jets themselves. The actuators receive control signals from the circuit board and those actuators that receive print signals actuate the jets to deposit a drop of ink.

The circuit board contains circuit board outlets that correspond to the manifold plate outlets and the siphon vents. Similarly, the jet stack has jet stack outlets that correspond to the circuit board outlets, the manifold plate outlets and ultimately the siphon vents. These outlets exist in addition to the array of jets that deposit ink. This separates the ink path from the air path and reduces the amount of waste ink. In addition, the circuit board acts as a cover for the vent diverter channels shown in FIGS. 3 and 4. In this embodiment, tabs 70 cover the vent channels to route the air down to the jet stack vent outlets. All vent outlets eventually exit the stack similarly to the jets, but in separate locations such as shown in the circles 54.

The outlets through the various plates should have a particular resistance. The orifices forming the outlets should have a resistance low enough to allow the air to pass through the outlet to exit the system, yet should have resistance high enough to prevent air from entering the system in the reverse direction. The resistance of the orifice relates to the size, with larger orifices resulting in less resistance. The diameter of the orifices needs to be large enough to allow air out, but small enough that the meniscus of the orifice has sufficient strength to prevent air from entering.

In this manner, air that builds up in a print system may exit the system without generating excessive amounts of waste ink. As previously mentioned, the ink in the siphons farthest from the jets provides the most air in the system. A vent in the ink reservoir allows that air to exit the system outside the ink path. Air arising in the ink reservoir exits the system in channels and outlets that are separate from the jet path when the purge pressure is applied.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A printhead reservoir assembly, comprising:

a reservoir having at least one reservoir to hold ink;

an outlet plate having siphon vents to allow air to exit an ink path;

a manifold plate having at least one manifold to channel ink and manifold outlets to corresponding to the siphon vents;

a jet stack having an array of jets to transfer ink out of the printhead reservoir assembly to a printing substrate and jet stack outlets corresponding to the siphon vents; and a circuit board between the jet stack and the manifold plate to operate the jet stack, the circuit board having outlets corresponding to the siphon vents.

2. The printhead reservoir assembly of claim 1, wherein the reservoir comprises four reservoirs.

3. The printhead reservoir assembly of claim 1, wherein the reservoir comprises an air vent.

4. The printhead reservoir assembly of claim 1, wherein the reservoir comprises siphons to channel the air to the siphon vents.

5. The printhead reservoir assembly of claim 4, wherein the siphons are angled and the siphon vents reside at peaks of the siphons.

6. The printhead reservoir assembly of claim 1, wherein the manifold comprises at least one air trap.

7. The printhead reservoir assembly of claim 6, wherein the air trap further comprises a scalloped edge of the manifold.

8. The printhead reservoir assembly of claim 1, wherein the manifold plate comprises at least one diverter channel to divert the air into the manifold outlets.

9. The printhead reservoir assembly of claim 1, wherein the siphon outlets, the manifold outlets, the jet stack outlets and the circuit board outlets comprise outlet channels for venting.

10. The printhead reservoir assembly of claim 9, wherein the vent orifices have a size large enough to allow air to exit the orifices in a First direction and small enough to hold a meniscus of sufficient strength to prevent air from entering in a second direction.

* * * * *